US008241185B2

(12) United States Patent
Ikegami

(10) Patent No.: US 8,241,185 B2
(45) Date of Patent: Aug. 14, 2012

(54) TRAMPOLINE WITH ATTACHMENT FRAME ASSEMBLY

(75) Inventor: Masato Ikegami, Tokyo (JP)

(73) Assignee: Funtek USA, Inc., San Diego, CA (US)

( * ) Notice: Subject to any disclaimer, the term of this patent is extended or adjusted under 35 U.S.C. 154(b) by 0 days.

(21) Appl. No.: 12/768,611

(22) Filed: Apr. 27, 2010

(65) Prior Publication Data

US 2010/0285926 A1 Nov. 11, 2010

Related U.S. Application Data

(60) Provisional application No. 61/176,029, filed on May 6, 2009.

(51) Int. Cl.
*A63B 21/00* (2006.01)

(52) U.S. Cl. ..... 482/27; 482/28

(58) Field of Classification Search ..... 482/27–30
See application file for complete search history.

(56) References Cited

U.S. PATENT DOCUMENTS 3,339,925 A 11/1964 Nissen
4,433,838 A * 2/1984 Gordon ..... 473/473
5,833,557 A 11/1998 Cole
6,135,922 A 10/2000 Nissen
7,331,903 B2 * 2/2008 Nissen et al. ..... 482/27
2004/0053712 A1 3/2004 Allison
2009/0280961 A1 11/2009 Ikegami

FOREIGN PATENT DOCUMENTS

EP 1 504 794 A1 2/2005
FR 2 623 719 A1 6/1989

OTHER PUBLICATIONS

Extended European Search Report for European patent application No. 10161889.0, publication date Aug. 23, 2010, Funtek USA, Inc.

* cited by examiner

*Primary Examiner* — Jerome W Donnelly
(74) *Attorney, Agent, or Firm* — Roeder & Broder LLP

(57) ABSTRACT

A trampoline (10) includes a bed (14), a base frame (12), a bed suspension assembly (16) that resiliently couples the bed (14) to the base frame (12), and a plurality of legs (20) that are connected to the base frame (12) so as to maintain the base frame (12) above a surface (36). The base frame (12) includes a first side frame (22), a second side frame (24), a first end frame (26), and a second end frame (28). The plurality of legs (20) includes (i) a first leg (20A) that is secured to the first side frame (22) and the first end frame (26), (ii) a second leg (20B) that is secured to the first side frame (22) and the second end frame (28), (iii) a third leg (20C) that is secured to the second side frame (24) and the second end frame (28), and (iv) a fourth leg (20D) that is secured to the second side frame (24) and the first end frame (26). The trampoline can further include a backstop frame (244A) that is mounted on the base frame (12) and that extends in a generally upward direction away from the base frame (12).

20 Claims, 7 Drawing Sheets

TRAMPOLINE WITH ATTACHMENT FRAME ASSEMBLY

RELATED INVENTIONS

This application claims priority on U.S. Provisional Application Ser. No. 61/176,029, filed May 6, 2009 and entitled "TRAMPOLINE WITH ATTACHMENT FRAME ASSEMBLY". As far as permitted, the contents of U.S. Provisional Application Ser. No. 61/176,029 are incorporated herein by reference.

BACKGROUND

For many, many years bouncing on a trampoline has been viewed as a fun and entertaining activity for people of various ages. In more recent years, research has demonstrated that bouncing on trampolines, even minimally, can be useful in the development of balance, aerobic capacity, motor skills and muscle strength. Accordingly, many games and activities have been created to encourage greater use of trampolines by people of various ages. In some instances, special attachments are required to be used in conjunction with a trampoline in order to allow people to safely participate in some of these games and activities. Additionally, in some situations the design of the trampoline itself can be altered to enhance the safety, stability and functionality of the trampoline during playing of these games and activities, without sacrificing any of the many benefits derived from participating in trampolining, including aerobic exercise, strength, balance, agility, coordination, timing, rhythm and fun.

SUMMARY

The present invention is directed toward a trampoline that is adapted to be positioned on a surface. In some embodiments, the trampoline comprises a bed, a base frame, a bed suspension assembly that resiliently couples the bed to the base frame, and a plurality of legs that are connected to the base frame so as to maintain the base frame above the surface. The base frame includes a first side frame, a second side frame, a first end frame, and a second end frame. The plurality of legs includes (i) a first leg that is secured to the first side frame and the first end frame, (ii) a second leg that is secured to the first side frame and the second end frame, (iii) a third leg that is secured to the second side frame and the second end frame, and (iv) a fourth leg that is secured to the second side frame and the first end frame.

In certain embodiments, the plurality of legs further includes a fifth leg that is secured to the first side frame and a sixth leg that is secured to the second side frame. In such embodiments, the trampoline can further comprise a center frame that is coupled to the first side frame substantially adjacent to the fifth leg and that is coupled to the second side frame substantially adjacent to the sixth leg. The center frame extends in a generally upward direction away from the first side frame and the second side frame. In one such embodiment, the center frame includes a first center frame member and a spaced apart second center frame member. The first center frame member is coupled to the first side frame substantially adjacent to the fifth leg and is coupled to the second side frame substantially adjacent to the sixth leg. Somewhat similarly, the second frame member is coupled to the first side frame substantially adjacent to the fifth leg and is coupled to the second side frame substantially adjacent to the sixth leg.

In some embodiments, the trampoline further comprises a backstop frame that is mounted on the base frame and that extends in a generally upward direction away from the base frame. The backstop frame includes a substantially straight first lower support member that is coupled to the base frame, a substantially straight second lower support member that is spaced apart from the first lower support member and that is coupled to the base frame, and a substantially arch shaped upper support member that extends from near a distal end of the first lower support member to near a distal end of the second lower support member. In one such embodiment, the trampoline further comprises a second backstop frame, a third backstop frame, and a fourth backstop frame that are mounted on the base frame and that extend in a generally upward direction away from the base frame. The backstops frames can be oriented such that each of the backstop frames is selectively coupled to one or more of the other backstop frames.

In one embodiment, the first side frame includes a first inner side frame and a first outer side frame and the second side frame includes a second inner side frame and a second outer side frame. In such embodiment, the bed suspension assembly can resiliently couple the bed to the first inner side frame, the second inner side frame, the first end frame and the second end frame. Additionally, in one embodiment, the trampoline can further include a plurality of connector bars that are positioned between the first inner side frame and the first outer side frame and between the second inner side frame and the second outer side frame.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
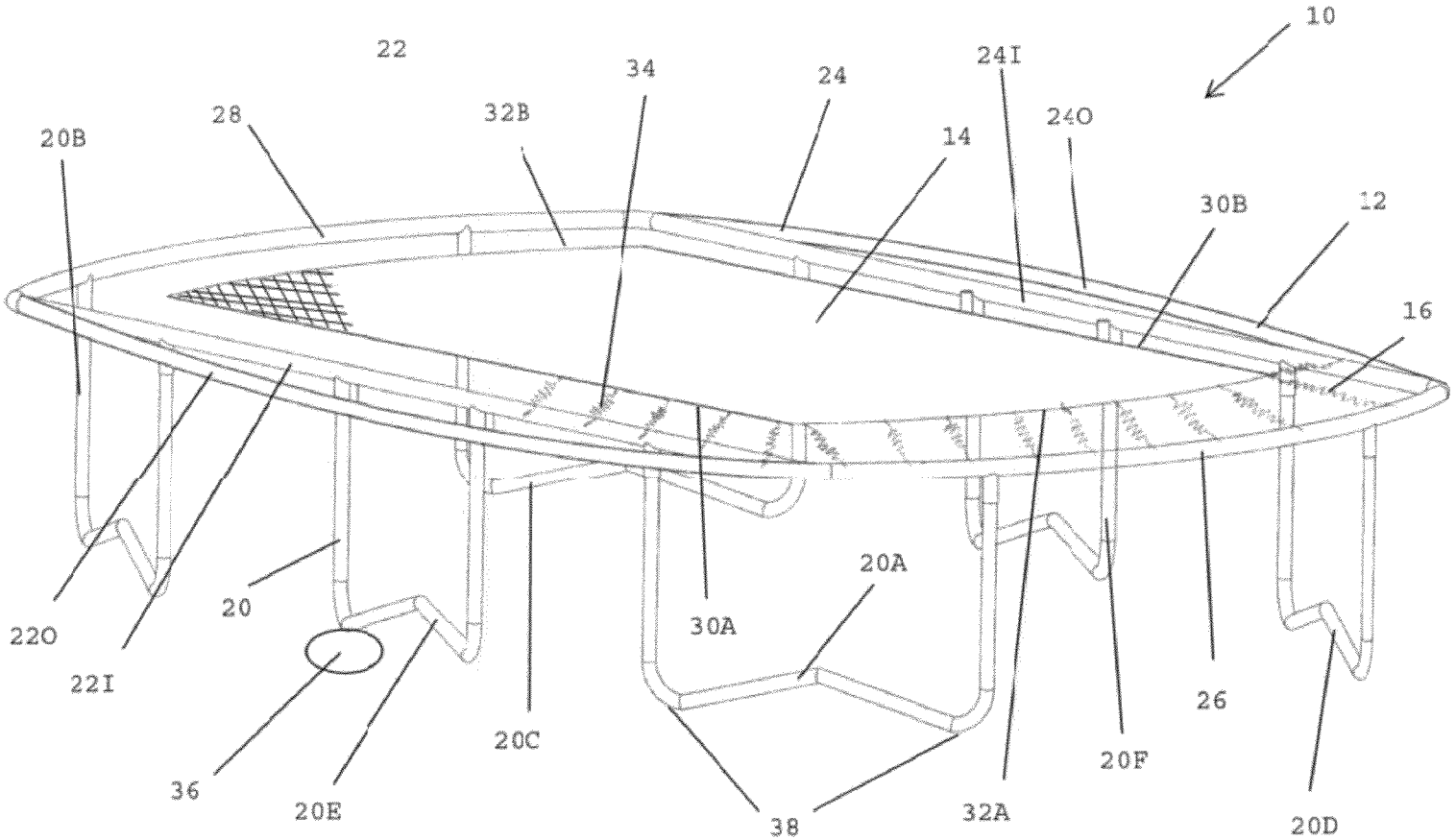
FIG. 1A is a perspective view of an embodiment of a trampoline having features of the present invention.

FIG. 1A is a perspective view of an embodiment of a trampoline 10 having features of the present invention. In the embodiment illustrated in FIG. 1A, the trampoline 10 includes a base frame 12, a bed 14, a bed suspension assembly 16, a cover 18 (illustrated, for example, in FIGS. 3B-3D), and a plurality of legs 20. The bed suspension assembly 16 resiliently couples the bed 12 to the base frame 14, so as to place the bed 12 in tension.

Figure 2:
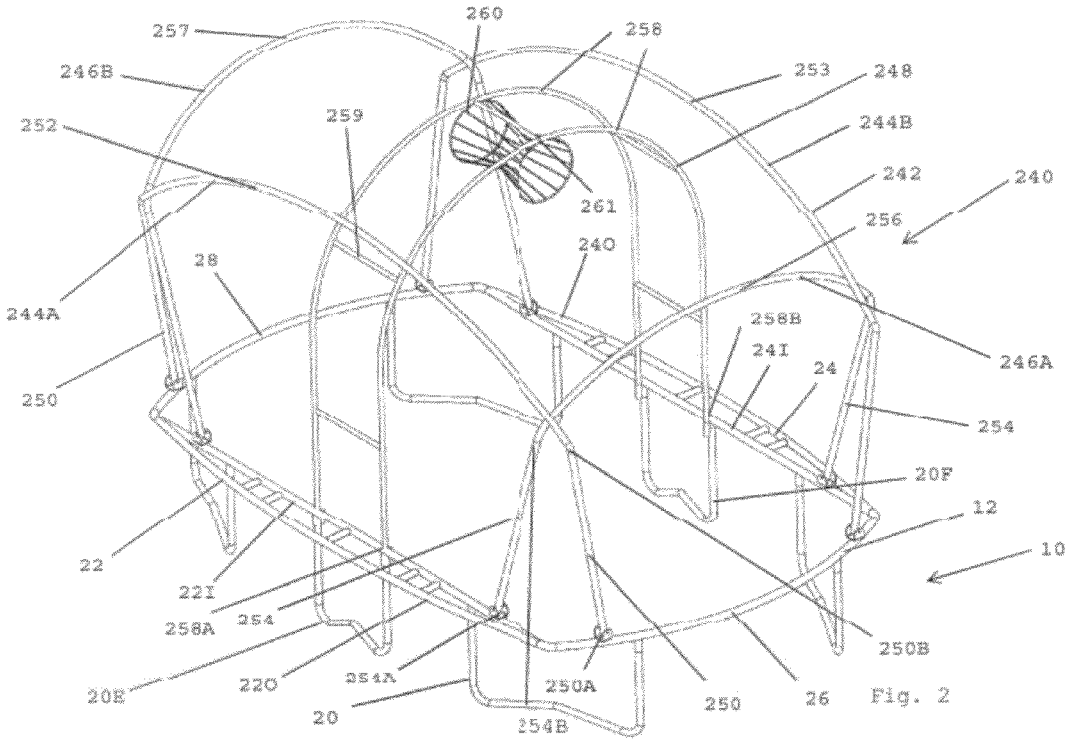
FIG. 2 is a simplified perspective view of a portion of the trampoline illustrated in FIG. 1A and a portion of an attachment frame assembly having features of the present invention.

As an overview, the trampoline 10 of the present invention is able to provide a stronger and more stable jumping and playing environment for a person using the trampoline 10. Additionally, in some embodiments, the trampoline 10 can include certain attachments, e.g., backstop frames and center gantry frame, as illustrated in FIG. 2, for example, that are designed to enhance the user's experience with the trampoline 10, and that include features that ensure that such attachments further achieve the desired improved strength and stability characteristics of the trampoline 10.

Figure 1B:
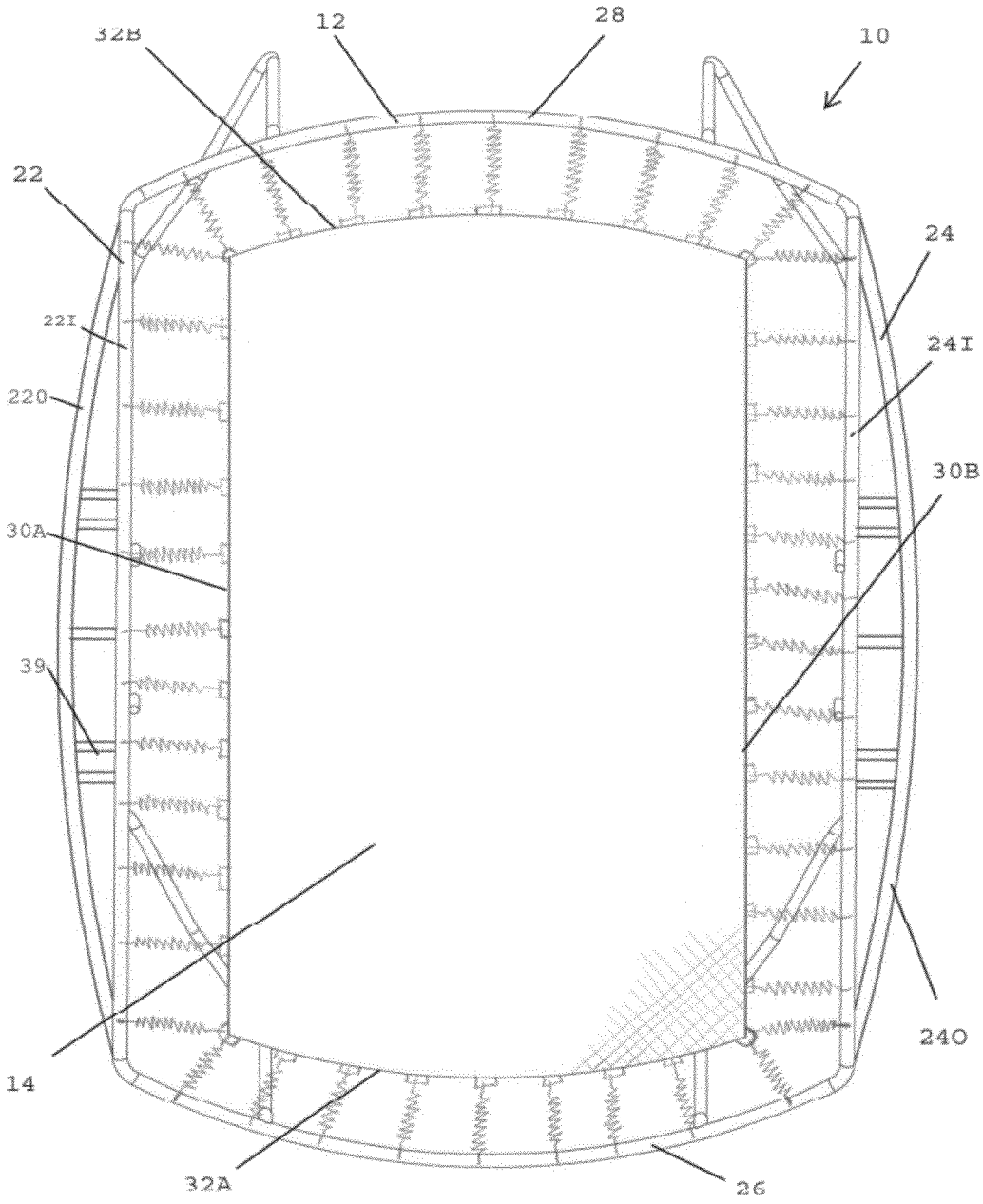
FIG. 1B is simplified top perspective view of the trampoline illustrated in FIG. 1A.

The design of the base frame 12 can be varied depending on the requirements of the trampoline 10, the bed 14 and/or the bed suspension assembly 16. In the embodiment illustrated in FIG. 1A, the base frame 12 is generally rectangular in shape and includes a first side frame 22, an opposed second side frame 24, a first end frame 26, and an opposed second end frame 28. As shown in FIG. 1A and as best illustrated in FIG. 1B, the first side frame 22 includes a first inner side frame 22I that is substantially straight and a first outer side frame 22O that is slightly curved in shape. Somewhat similarly, the second side frame 24 includes a second inner side frame 24I that is substantially straight and a second outer side frame 24O that is slightly curved in shape. In one embodiment, the first inner side frame 22I is spaced apart from and substantially parallel to the second inner side frame 24I. In certain alternative embodiments, the first end frame 26 can be designed to include a first inner end frame and a first outer end frame, and/or the second end frame 28 can be designed to include a second inner end frame and a second outer end frame. Still alternatively, the base frame 12 can be designed without the outer side frames 22O, 24O or without the inner side frames 22I, 24I.

It should be noted that the use of the terms "first side frame", "second side frame", "first end frame", and "second end frame" is done for convenience of description only, and that either of the side frames 22, 24 can be referred to as the "first side frame" or the "second side frame", and that either of the end frames 26, 28 can be referred to as the "first end frame" or the "second end frame" without altering the breadth or scope of the present invention.

In this embodiment, the first inner side frame 22I is secured to the first outer side frame 22O and extends from a point proximate to an end of the first outer side frame 22O that is adjacent to the first end frame 26 to a point proximate to an end of the first outer side frame 22O that is adjacent to the second end frame 28. Somewhat similarly, the second inner side frame 24I is secured to the second outer side frame 24O and extends from a point proximate to an end of the second outer side frame 24O that is adjacent to the first end frame 26 to a point proximate to an end of the second outer side frame 24O that is adjacent to the second end frame 28. Alternatively, the inner side frames 22I, 24I can be secured to the outer side frames 22O, 24O, respectively, at different points. Still alternatively, the inner side frames 22I, 24I can be secured to the end frames 26, 28.

It should be noted that the inclusion of the first inner side frame 22I and the first outer side frame 22O, and the second inner side frame 24I and the first outer side frame 24O, as well as the possible inclusion of inner and outer end frames, help to enable a person to stand on top of the base frame 12 of the trampoline 10. For example, one or more support platforms can further be included on top of the inner side frames 22I, 24I and the outer side frames 22O, 24O, and/or on top of the inner and outer end frames. With this design, a person may be better able to assist or otherwise support another person who is utilizing the trampoline 10.

In certain embodiments, the base frame 12 can include a plurality of sections that can be secured together to form the base frame 12. For example, each of the inner side frames 22I, 24I, the outer side frames 22O, 24O, and the end frames 26, 28 can be individual sections or can be made up of more than one section. With this modular-type design, shipping and disassembly for storage of the base frame 12 is facilitated. Alternatively, the entire base frame 12 can be formed as a unitary structure.

Further, the base frame 12 can be formed from various materials such as metal, wood, plastic, composite materials, ceramic, or any other suitably rigid materials. Alternatively, a combination of any of such materials can be used.

The design of the bed 14 can be varied depending upon the requirements of the trampoline 10 and/or the base frame 12. In the embodiment illustrated in FIG. 1A, the bed 14 is substantially rectangular in shape and includes a pair of substantially parallel bed sides 30A, 30B and a pair of generally parallel bed ends 32A, 32B. More particularly, the bed sides 30A, 30B are substantially straight and generally parallel to the inner side frames 22I, 24I, and the bed ends 32A, 32B are slightly curved so that the bed ends 32A, 32B can generally follow a contour of the end frames 26, 28 of the base frame 12. Alternatively, the bed 14 can be designed to be substantially circle shaped, oval shaped, square shaped, or some other shape.

Further, the bed 14 can be formed from various sturdy fabric materials that are designed to withstand the repeated impact from a person jumping on the trampoline 10. For example, the bed 14 can be formed from a mesh material or other similar material. Alternatively, the bed 14 can be formed from materials including heavy canvas, vinyl, or nylon.

The bed suspension assembly 16 resiliently couples the bed 14 to the base frame 12, so as to maintain the bed 14 in tension. In the embodiment illustrated in FIG. 1A, the bed suspension assembly 16 resiliently couples one bed side 30A to the first inner side frame 22I, resiliently couples the other bed side 30B to the second inner side frame 24I, resiliently couples one bed end 32A to the first end frame 26, and resiliently couples the other bed end 32B to the second end frame 28. Alternatively, the bed suspension assembly 16 can resiliently couple the bed sides 30A, 30B to the outer side frames 22O, 24O, respectively.

The bed suspension assembly 16 can include a plurality of resilient members 34. For example, each resilient member 34 can include a spring, elastic, plastic, rubber, or other suitably resilient structure. The size and number of the resilient members 34 can vary. For example, in one embodiment, the trampoline 10 can include approximately 62 similarly-sized extension springs equally spaced around the perimeter of the bed 14. Each spring can have a one-inch diameter and be formed from 12-gauge steel. However, the trampoline 10 can be designed to have greater than 62 or fewer than 62 springs that have various dimensions and are made of various materials.

The cover 18 substantially covers at least a portion of the plurality of resilient members 34 and at least a portion of the base frame 12. The cover 18 is designed to help protect the user from injury by preventing the user from getting hands or feet or other body parts caught or pinched within the plurality of resilient members 34. Additionally, the cover 18 is designed to help protect the user from injury by preventing the user from directly contacting the rigid materials used to form the base frame 12. The cover 18 can be made of nylon or other suitable, pliable material. In certain embodiments, a layer of padding (not illustrated) can be positioned between the cover 18 and the plurality of resilient members 34 and/or between the cover 18 and the base frame 12.

The legs 20 are connected to the base frame 12 and are spaced apart around the base frame 12, so as to maintain the base frame 12 and the bed 14 above a support surface 36 (also referred to herein as the "surface"), such as a floor or the ground. The configuration of the legs 20 and the number of legs 20 can vary. For example, as illustrated in FIG. 1A, the trampoline 10 can include six legs 20 that are spaced apart around the base frame 12. Alternatively, the trampoline 10 can be designed to have more than six or less than six legs 20

In this embodiment, each leg 20 can be somewhat W-shaped for rigidity and strength. Further, with this design, each leg 20 has a pair of spaced apart contact points 38 with the support surface 36 for increased stability. Alternatively, the legs 20 can have other than a W-shaped design and each leg 20 can have more than two or less than two contact points 38 with the support surface 36.

In the embodiment illustrated in FIG. 1A, the plurality of legs 20 includes (i) a first leg 20A that is connected to the first side frame 22 and the first end frame 26, (ii) a second leg 20B that is connected to the first side frame 22 and the second end frame 28, (iii) a third leg 20C that is connected to the second side frame 24 and the second end frame 28, (iv) a fourth leg 20D that is connected to the second side frame 24 and the first end frame 26, (v) a fifth leg 20E that is connected at two points to the first side frame 22, and (vi) a sixth leg 20F that is connected at two points to the second side frame 24. More particularly, (i) the first leg 20A is connected to the first inner side frame 22I and the first end frame 26, (ii) the second leg 20B is connected to the first inner side frame 22I and the second end frame 28, (iii) the third leg 20C is connected to the second inner side frame 24I and the second end frame 28, (iv) the fourth leg 20D is connected to the second inner side frame 24I and the first end frame 26, (v) the fifth leg 20E is connected at two points to the first inner side frame 22I, and (vi) the sixth leg 20F is connected at two points to the second inner side frame 24I. Alternatively, one or more of the legs 20A-20F can be connected to the outer side frames 22O, 24O instead of the inner side frames 22I, 24I. Still alternatively, the trampoline 10 can be designed without the fifth leg and the sixth leg.

It should be noted that the use of the terms "first leg", "second leg", "third leg", "fourth leg", "fifth leg", and "sixth leg" is done for convenience of description only, and any of the legs 20A-20F can be referred to as the "first leg", "second leg", "third leg", "fourth leg", "fifth leg", or "sixth leg" without altering the breadth and scope of the present invention.

Additionally, the positioning of the first leg 20A, the second leg 20B, the third leg 20C and the fourth leg 20D, as shown in the embodiment illustrated in FIG. 1A, enable the trampoline 10 to provide a much safer, stronger and sturdier jumping environment for the user of the trampoline 10. For example, when the trampoline 10 includes one or more backstop frames 344A, 344B, 346A, 346B, such as in the embodiment illustrated in FIGS. 3A-3D, the trampoline is much less likely to tip and/or the legs 20A-20D are much less likely to buckle or collapse when a person using the trampoline 10 jumps into one of the end beds 370A, 370B (illustrated in FIG. 3B) or the side netting 376 (illustrated in FIG. 3D).

FIG. 1B is simplified top perspective view of the trampoline 10 illustrated in FIG. 1A. In particular, FIG. 1B better illustrates the shape of the base frame 12 and the bed 14 of the trampoline 10. For example, FIG. 1B illustrates that the first inner side frame 22I and the second inner side frame 24I are substantially straight and parallel to each other. Additionally, the bed sides 30A, 30B are substantially straight and parallel to each other and parallel to the inner side frames 22I, 24I.

Additionally, FIG. 1B illustrates that the first outer side frame 22O and the second outer side frame 24O are slightly curved in shape, and the first end frame 26 and the second end frame 28 are also slightly curved in shape, so as to provide a slightly rounded outer perimeter to the overall generally rectangular shape of the base frame 12. Further, the bed ends 32A, 32B are slightly curved so that the bed ends 32A, 32B can generally follow a contour of the end frames 26, 28 of the base frame 12. Alternatively, the base frame 12 can be designed so that the outer perimeter is generally circle shaped, oval shaped, square shaped, or some other shape. Additionally and/or alternatively, as noted above, the bed 14 can also be designed to be generally circle shaped, oval shaped, square shaped, or some other shape.

In certain embodiments, the radius of curvature of the outer side frames 22O, 24O is different than the radius of curvature of the end frames 26, 28. For example, in one embodiment, the radius of curvature of the outer side frames 22O, 24O is greater than the radius of curvature of the end frames 26, 28, so as to compensate for the greater length of the side frames 22, 24 in comparison to the end frames 26, 28. Alternatively, the radius of curvature of the outer side frames 22O, 24O can be substantially equal to or less than the radius of curvature of the end frames 26, 28.

It should be noted that slightly curved outer perimeter of the base frame 12 provides added strength and stability to the base frame 12 while still maintaining a relatively smaller footprint.

Additionally, as shown in the embodiment illustrated in FIG. 1B, the base frame 12 further includes a plurality of connector bars 39 that are positioned between the inner side frames 22I, 24I and the outer side frames 22O, 24O. The connector bars 39 enhance the overall stability of the base frame 12. In this embodiment, the base frame 12 includes five connector bars 39 that are positioned between the first inner side frame 22I and the first outer side frame 22O, and five connector bars 39 that are positioned between the second inner side frame 24I and the second outer side frame 24O. In alternative embodiments, the base frame 12 can be designed to include more than five or less than five connector bars 39 positioned between the first inner side frame 22I and the first outer side frame 22O, and more than five or less than five connector bars 39 positioned between the second inner side frame 24I and the second outer side frame 24O.

FIG. 2 is a simplified perspective view of a portion of the trampoline 10 illustrated in FIG. 1A and a portion of an attachment frame assembly 240 having features of the present invention. More particularly, FIG. 2 illustrates the base frame 12 and legs 20 illustrated in FIG. 1A, and an attachment frame 242 that makes up a portion of the attachment frame assembly 240.

The design of the attachment frame 242 can be varied to suit the requirements of the trampoline 10 and the attachment frame assembly 240. As illustrated, the attachment frame 242 includes a substantially arch-shaped first side backstop frame 244A, a spaced apart, substantially arch-shaped second side backstop frame 244B, a substantially arch-shaped first end backstop frame 246A, a spaced apart, substantially arch-shaped second end backstop frame 246B, and a substantially arch-shaped center gantry frame 248. Each of the backstop frames 244A, 244B, 246A, 246B and the center gantry frame 248 are designed to extend in a generally upward direction away from the base frame 12. Additionally, each of the backstop frames 244A, 244B, 246A, 246B project slightly outward radially from the center of the base frame 12. Alternatively, the attachment frame 242 can be designed without one or both of the side backstop frames 244A, 244B, without one or both of the end backstop frames 246A, 246B, and/or without the center gantry frame 248.

In this embodiment, the first side backstop frame 244A includes a pair of spaced apart substantially straight lower support members 250 that are coupled to the base frame 12 and that extend in a generally upward direction away from the base frame 12, and a substantially arch-shaped upper support member 252 that is coupled to and extends between the lower support members 250. More particularly, as illustrated in FIG. 2, the first side backstop frame 244A can include the pair of spaced apart lower support members 250, wherein each lower support member 250 includes a proximal end 250A that is coupled to the base frame 12 and a distal end 250B that is positioned above the base frame 12, and the upper support member 252 is coupled to each of the distal ends 250B of the lower support members 250. In one embodiment, the proximal end 250A of one of the lower support members 250 is coupled to the first end frame 26 of the base frame 12 and the proximal end 250A of the other lower support member 250 is coupled to the second end frame 28 of the base frame 12. Alternatively, the proximal ends 250A of the lower support members 250 can be coupled to a different portion of the base frame 12, such as the first inner side frame 22I or the first outer side frame 22O.

Further, as illustrated in this embodiment, the first side backstop frame 244A projects slightly outward radially from the center of the base frame 12, so that an apex 253 of the first side backstop frame 244A is substantially directly above the first outer side frame 22O of the base frame 12.

The second side backstop frame 244B is somewhat similar in design and orientation to the first side backstop frame 244A. For example, as illustrated, the second side backstop frame 244B includes a pair of spaced apart substantially straight lower support members 250 that are coupled to the base frame 12 and that extend in a generally upward direction away from the base frame 12, and a substantially arch-shaped upper support member 252 that is coupled to and extends between the lower support members 250. More particularly, as illustrated in FIG. 2, the second side backstop frame 244B can include the pair of spaced apart lower support members 250, wherein each lower support member 250 includes a proximal end 250A that is coupled to the base frame 12 and a distal end 250B that is positioned above the base frame 12, and the upper support member 252 is coupled to each of the distal ends 250B of the lower support members 250. In one embodiment, the proximal end 250A of one of the lower support members 250 is coupled to the first end frame 26 of the base frame 12 and the proximal end 250A of the other lower support member 250 is coupled to the second end frame 28 of the base frame 12. Alternatively, the proximal ends 250A of the lower support members 250 can be coupled to a different portion of the base frame 12, such as the second inner side frame 24I or the second outer side frame 24O.

Further, as illustrated in this embodiment, the second side backstop frame 244B projects slightly outward radially from the center of the base frame 12, so that an apex 253 of the second side backstop frame 244B is substantially directly above the second outer side frame 24O of the base frame 12.

Additionally, in this embodiment, the first end backstop frame 246A includes a pair of spaced apart substantially straight lower support members 254 that are coupled to the base frame 12 and that extend in a generally upward direction away from the base frame 12, and a substantially arch-shaped upper support member 256 that is coupled to and extends between the lower support members 254. More particularly, as illustrated in FIG. 2, the first end backstop frame 246A can include the pair of spaced apart lower support members 254, wherein each lower support member 254 includes a proximal end 254A that is coupled to the base frame 12 and a distal end 254B that is positioned above the base frame 12, and the upper support member 256 is coupled to each of the distal ends 254B of the lower support members 254. In one embodiment, the proximal end 254A of one of the lower support members 254 is coupled to the first inner side frame 22I of the base frame 12 and the proximal end 254A of the other lower support member 254 is coupled to the second inner side frame 24I of the base frame 12. Alternatively, the proximal ends 254A of the lower support members 254 can be coupled to a different portion of the base frame 12, such as the outer side frames 22O, 24O, and/or the first end frame 26.

Further, as illustrated in this embodiment, the first end backstop frame 246A projects slightly outward radially from the center of the base frame 12, so that an apex 257 of the first end backstop frame 246A is substantially directly above the first end frame 26 of the base frame 12.

The second end backstop frame 246B is somewhat similar in design and orientation to the first end backstop frame 246A. For example, as illustrated, the second end backstop frame 246B includes a pair of spaced apart substantially straight lower support members 254 that are coupled to the base frame 12 and that extend in a generally upward direction away from the base frame 12, and a substantially arch-shaped upper support member 256 that is coupled to and extends between the lower support members 254. More particularly, as illustrated in FIG. 2, the second end backstop frame 246B can include the pair of spaced apart lower support members 254, wherein each lower support member 254 includes a proximal end 254A that is coupled to the base frame 12 and a distal end 254B that is positioned above the base frame 12, and the upper support member 256 is coupled to each of the distal ends 254B of the lower support members 254. In one embodiment, the proximal end 254A of one of the lower support members 254 is coupled to the first inner side frame 22I of the base frame 12 and the proximal end 254A of the other lower support member 254 is coupled to the second inner side frame 24I of the base frame 12. Alternatively, the proximal ends 254A of the lower support members 254 can be coupled to a different portion of the base frame 12, such as the outer side frames 220, 24O, and/or the second end frame 28.

Further, as illustrated in this embodiment, the second end backstop frame 246B projects slightly outward radially from the center of the base frame 12, so that an apex 257 of the second end backstop frame 246B is substantially directly above the second end frame 28 of the base frame 12.

Still further, each of the backstop frames 244A, 244B, 246A, 246B can include a plurality of sections that can be secured together to form the backstop frames 244A, 244B, 246A, 246B. With this modular-type design, shipping and disassembly for storage of the backstop frames 244A, 244B, 246A, 246B is facilitated. Alternatively, each of the backstop frames 244A, 244B, 246A, 246B can be formed as a unitary structure.

In some embodiments, each of the end backstop frames 246A, 246B can be selectively coupled to one or both of the side backstop frames 244A, 244B, and each of the side backstop frames 244A, 244B can be selectively coupled to one or both of the end backstop frames 246A, 246B. This design can be utilized to increase the sturdiness of the attachment frame 242.

It should be noted that the use of the lower support members 250, 254 in combination with the upper support members 252, 256, respectively, enables the backstop frames 244A, 244B, 246A, 246B to provide a stronger, sturdier and more resilient surface, via the end beds 370A, 370B (illustrated in FIG. 3B) and the side netting 376 (illustrated in FIG. 3D), for the user of the trampoline 10 when jumping into the end beds 370A, 370B or the side netting 376.

The design of the center gantry frame 248 can be varied depending on the requirements of the trampoline 10 and the attachment frame 242. In this embodiment, the center gantry frame 248 includes a pair of spaced apart substantially arch-shaped center frames 258, and a plurality of support bars 259 that extend between and connect the center frames 258 together. In one embodiment, the center frames 258 are positioned approximately three feet apart from each other. Alternatively, the center frames 258 can be positioned greater than three feet or less than three feet away from each other.

In this embodiment, each of the center frames 258 is secured to the base frame 12 and extends in a generally upward direction away from the base frame 12. In particular, each of the center frames 258 includes a first end 258A and a spaced apart second end 258B that are coupled to the base frame 12. In the embodiment illustrated in FIG. 2, the first end 258A of each center frame 258 is secured to the first inner side frame 22I and the second end 258B of each center frame 258 is secured to the second inner side frame 24I. In some embodiments, each of the center frames 258 is coupled to the first inner side frame 22I substantially adjacent to one of the legs 20, e.g., the fifth leg 20E as illustrated in FIG. 1A. Somewhat similarly, in some embodiments, each of the center frames 258 is coupled to the second inner side frame 24I substantially adjacent to another one of the legs 20, e.g., the sixth leg 20F as illustrated in FIG. 1A. In one such embodiment, one or both of the center frames 258 can be integrally formed with the fifth leg 20E and/or the sixth leg 20F. Alternatively, the center frames 258 can be coupled to the base frame 12 at a different position. For example, each of the center frames 258 can be coupled to the first outer side frame 22O and/or the second outer side frame 24O of the base frame 12. In such embodiment, the center frames 258 can still be positioned substantially adjacent to and/or integrally formed with one or more of the legs 20.

It should be noted that the positioning of the center frames 258 adjacent to and/or integrally formed with one or more of the legs 20 improves the overall strength and sturdiness of the center gantry frame 248 during use of the trampoline 10.

Additionally, each of the center frames 258 can include a plurality of sections that can be secured together to form the center frame 258. With this modular-type design, shipping and disassembly for storage of the center frames 258 is facilitated. Alternatively, the each center frame 258 can be formed as a unitary structure.

The support bars 259 connect the center frames 258 together and provide additional support and sturdiness to the center gantry frame 248. As illustrated in this embodiment, the center gantry frame 248 can include five support bars 259 that are each connected to and extend between the center frames 258. Alternatively, the center gantry frame 248 can be designed with more than five or less than five support bars 259.

As illustrated, the center gantry frame 248 further includes a basket hoop 260 that is secured to the center frames 258 of the center gantry frame 248 approximately at an apex 261 of each of the center frames 258. The basket hoop 260 is designed for passing a spaceball through during playing of a game of spaceball.

The overall size of the base frame 12 and the attachment frame 242 can be varied. In this embodiment, the base frame 12 is designed to have a length 262 of approximately 167.7 inches, a width 264 of approximately 104.7 inches, and a height 266 of approximately 28.7 inches, which is the height of the base frame 12 above the support surface 36 (illustrated in FIG. 1A). Additionally, the attachment frame 242 is designed so that a maximum height 268 of the center gantry frame 248 is approximately 126.4 inches.

Figure 3A:
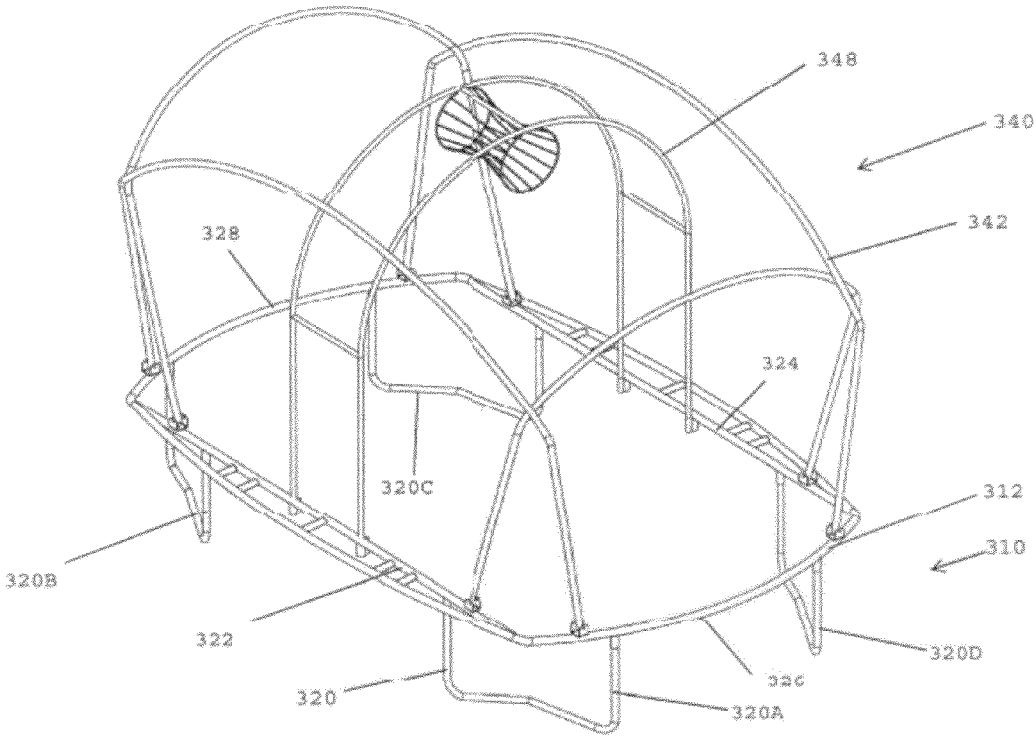
FIG. 3A is a simplified perspective view of a portion of a second embodiment of a trampoline and an attachment frame assembly having features of the present invention.

FIG. 3A is a simplified perspective view of a portion of a second embodiment of a trampoline 310 and an attachment frame assembly 340 having features of the present invention. More particularly, FIG. 3A illustrates a base frame 312, a plurality of legs 320, and an attachment frame 342 that makes up a portion of the attachment frame assembly 340.

In this embodiment, the general design of the base frame 312 and the attachment frame 342 is substantially similar to the general design of the base frame 12 and the attachment frame 242 as discussed above with regard to the previous embodiment. However, in this embodiment, the trampoline 310 includes four spaced apart legs 320 that are secured to the base frame 312. In particular, in this embodiment, the plurality of legs 320 includes (i) a first leg 320A that is connected to the first side frame 322 and the first end frame 326, (ii) a second leg 320B that is connected to the first side frame 322 and the second end frame 328, (iii) a third leg 320C that is connected to the second side frame 324 and the second end frame 328, and (iv) a fourth leg 320D that is connected to the second side frame 324 and the first end frame 326. In other words, in this embodiment, the base frame 312 does not include the fifth leg and the sixth leg that were included in the embodiment illustrated in FIG. 1A.

Additionally, the overall size of the base frame 312 and the attachment frame 342 in this embodiment are somewhat different than in the previous embodiment. In this embodiment, the base frame 312 is designed to have a length 362 of approximately 143.7 inches, a width 364 of approximately 92.5 inches, and a height 366 of approximately 28.7 inches, which is the height of the base frame 312 above the support surface 36 (illustrated in FIG. 1A). Additionally, the attachment frame 342 is designed so that a maximum height 368 of the center gantry frame 348 is approximately 109.5 inches.

Figure 3B:
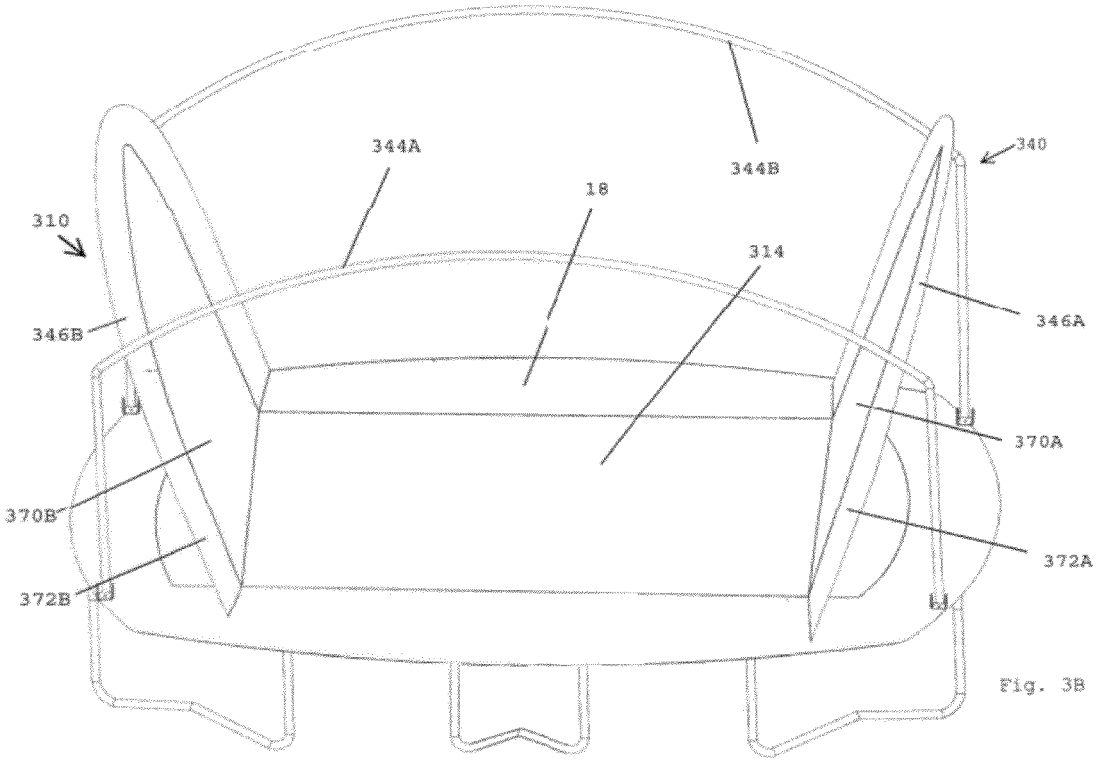
FIG. 3B is another perspective view of the trampoline and a portion of the attachment frame assembly illustrated in FIG. 3A.

FIG. 3B is another perspective view of the trampoline 310 and a portion of the attachment frame assembly 340 illustrated in FIG. 3A. As illustrated, the trampoline 310 is substantially similar to the trampoline 10 illustrated and described above with regard to FIG. 1A, with the cover 18 clearly illustrated. Accordingly, a detailed description of the trampoline 310 will not be provided.

As illustrated in FIG. 3B, the attachment frame assembly 340 includes a pair of spaced apart, substantially arch-shaped side backstop frames 344A, 344B, a pair of spaced apart, substantially arch-shaped end backstop frames 346A, 346B, a pair of end beds 370A, 370B, a pair of end suspension assemblies (not illustrated), and a pair of end covers 372A, 372B. In one embodiment, the end beds 370A, 370B are made from a material that is substantially similar to the material used to make the bed 314 of the trampoline 310. For example, as with the embodiment described in detail above, the bed 314 and the end beds 370A, 370B can be formed from a mesh material or other similar material. Alternatively, the end beds 370A, 370B can be made from other materials including heavy canvas, vinyl, or nylon.

The end suspension assemblies connect the end beds 370A, 370B to the end backstop frames 346A, 346B, so as to maintain the end beds 370A, 370B in tension. The design of the end suspension assemblies can be varied. For example, the end suspension assemblies can include a plurality of resilient members (not illustrated), such as a spring, elastic, plastic, rubber, or other suitably resilient structure.

The end covers 372A, 372B substantially cover at least a portion of the end suspension assemblies and at least a portion of the end backstop frames 346A, 346B. The end covers 372A, 372B are designed to help protect the user from injury by preventing the user from getting hands or feet or other body parts caught or pinched within the end suspension assemblies. Additionally, the end covers 372A, 372B are designed to help protect the user from injury by preventing the user from directly contacting the rigid materials used to form the end backstop frames 346A, 346B. The end covers 372A, 372B can be made of nylon or other suitable, pliable material. In certain embodiments, a layer of padding (not illustrated) can be positioned between the end covers 372A, 372B and the end suspension assemblies, and between the end covers 372A, 372B and the end backstop frames 346A, 346B.

Figure 3C:
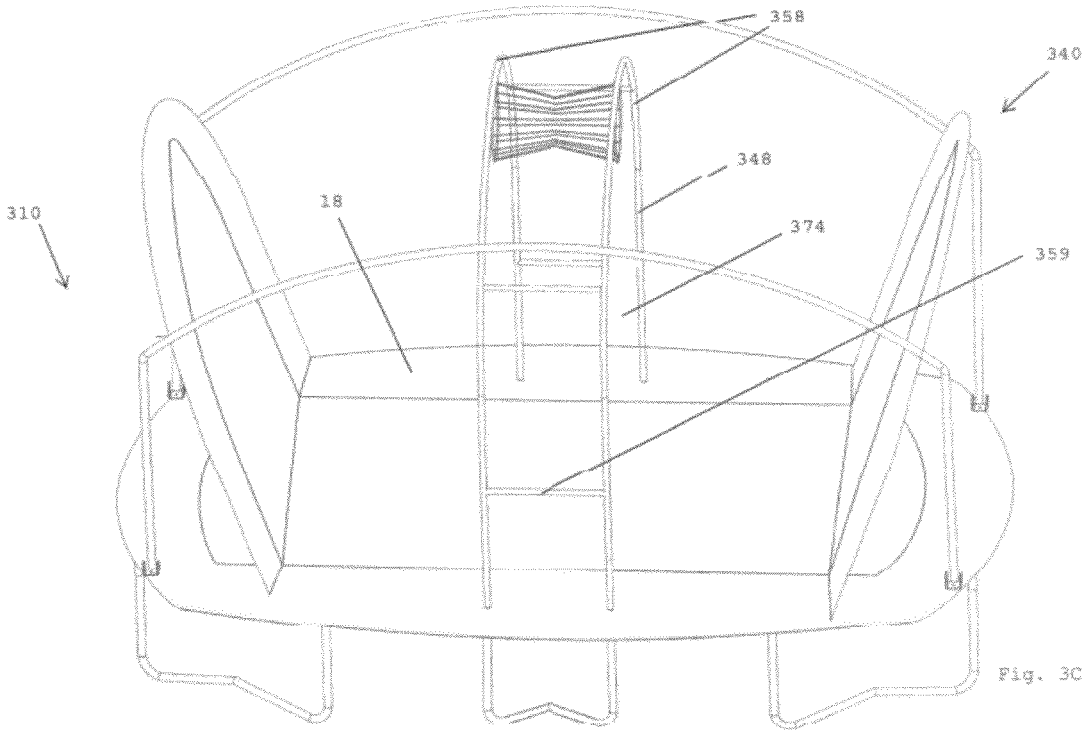
FIG. 3C is another perspective view of the trampoline and a portion of the attachment frame assembly illustrated in FIG. 3A.

FIG. 3C is another perspective view of the trampoline 310 and a portion of the attachment frame assembly 340 illustrated in FIG. 3A.

As illustrated in FIG. 3C, the attachment frame assembly 340 further includes the center gantry frame 348 having two substantially arch-shaped center frames 358, a plurality of support bars 359, a basket hoop 360, and a center gantry netting 374. The center frames 358, the support bars 359, and the basket hoop 360 are substantially similar to the center frames 258, the support bars 259, and the basket hoop 260 as illustrated and described above with regard to the embodiment described above in FIG. 2. Accordingly, a detailed description of the center frames 358, the support bars 359, and the basket hoop 360 will not be provided.

The center gantry netting 374 is positioned within the arched shape of each of the center frames 358, and the center gantry netting 374 is connected to the center frames 358 with a center suspension system (not illustrated). The center gantry netting 374 provides a resilient surface for the user to contact as the user nears the basket hoop 360, so as to protect the user from unwanted contact with the center frames 358 and/or the opposing player. In one embodiment, the center gantry netting 374 is made from a material that is different from the material used to make the bed 314 and the end beds 370A, 370B of the trampoline 310. More particularly, the center gantry netting 374 can be somewhat less sturdy than the material used to make the bed 314 and the end beds 370A, 370B of the trampoline 310, and the center gantry netting 374 can be substantially transparent so as to enable better viewing from one side of the center gantry frame 348 to the other side of the center gantry frame 348.

Figure 3D:
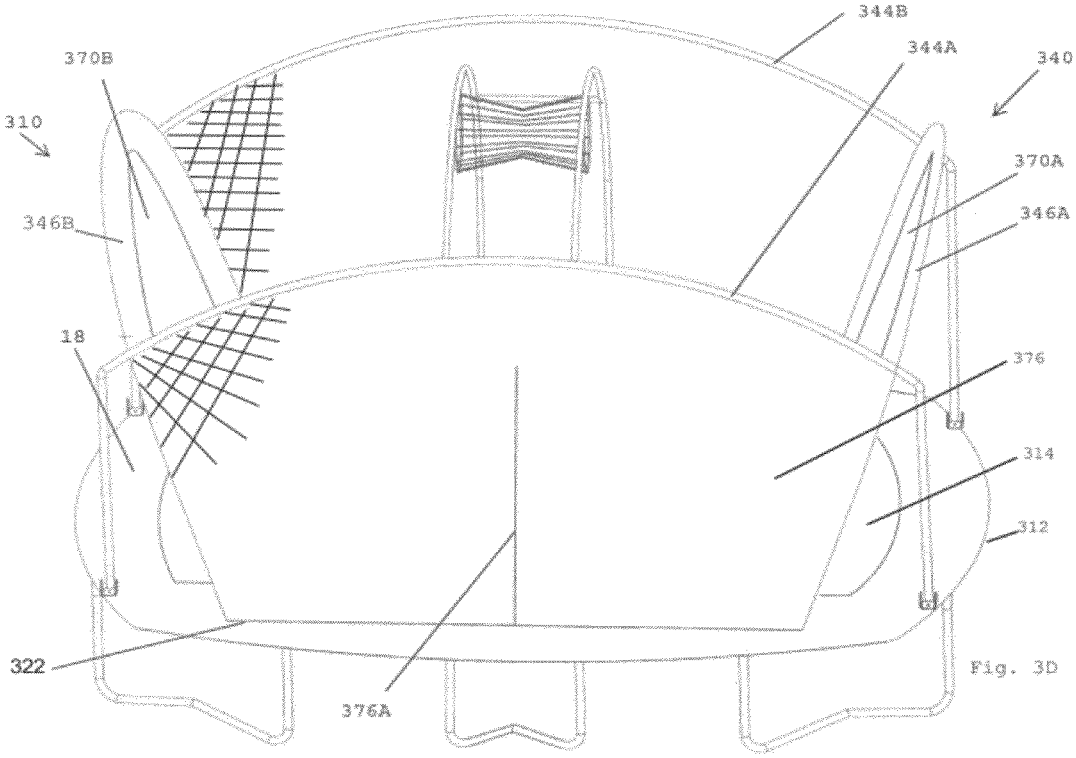
FIG. 3D is another perspective view of the trampoline and the attachment frame assembly illustrated in FIG. 3A.

FIG. 3D is another perspective view of the trampoline 310 and the attachment frame assembly 340 illustrated in FIG. 3A.

As illustrated in FIG. 3D, the attachment frame assembly 340 further includes a side netting 376 that is positioned adjacent to the side backstop frames 344A, 344B, the end backstop frames 346A, 346B and the side frames 322, 324 (illustrated in FIG. 3A) of the base frame 312, and is connected to the side backstop frames 344A, 344B, the end backstop frames 346A, 346B and the side frames 322, 324 of the base frame 312 with a side suspension system (not illustrated). The side netting 376 provides a resilient surface for the user to contact as the user uses the trampoline 310, so as to protect the user from falling off the side of the trampoline 310. In one embodiment, the side netting 376 is made from a material that is different from the material used to make the bed 314 and the end beds 370A, 370B of the trampoline 310. More particularly, the side netting 376 can be somewhat less sturdy than the material used to make the bed 314 and the end beds 370A, 370B of the trampoline 310, and the side netting 376 can be substantially transparent so as to enable better viewing of the action on the trampoline 310. Additionally, in certain embodiments, the side netting 376 can be made from a material that is substantially similar to the material utilized to make the center gantry netting 374 (illustrated in FIG. 3C).

Further, as illustrated, the side netting 376 includes an access seam 376A that enables the side netting 376 to be partially separated so as to enable persons to access the bed 314 of the trampoline 310 when the attachment frame assembly 340 is fully erected and attached to the base frame 312 of the trampoline 310.

While the particular trampolines 10 and 310, as herein shown and disclosed in detail, are fully capable of obtaining the objects and providing the advantages herein before stated, it is to be understood that they are merely illustrative of the particular preferred embodiments of the invention. No limitations are intended to the details of construction or design herein shown.

What is claimed is:

1. A trampoline that is adapted to be positioned on a surface, the trampoline comprising:

a bed;

a base frame including a first side frame having a first inner side frame and a first outer side frame, a second side frame having a second inner side frame and a second outer side frame, a first end frame, and a second end frame;

a bed suspension assembly that resiliently couples the bed to the base frame; and a plurality of legs that are connected to the base frame so as to maintain the base frame above the surface, the plurality of legs including (i) a first leg that is secured to the first inner side frame and the first end frame, (ii) a second leg that is secured to the first inner side frame and the second end frame, (iii) a third leg that is secured to the second inner side frame and the second end frame, and (iv) a fourth leg that is secured to the second inner side frame and the first end frame.

2. The trampoline of claim 1 wherein the plurality of legs includes a fifth leg that is secured to the first side frame and a sixth leg that is secured to the second side frame, and further comprising a center frame that is coupled to the first side frame substantially adjacent to the fifth leg and that is coupled to the second side frame substantially adjacent to the sixth leg, the center frame extending in a generally upward direction away from the first side frame and the second side frame.

3. The trampoline of claim 2 wherein the center frame includes a first center frame member that is coupled to the first side frame substantially adjacent to the fifth leg and that is coupled to the second side frame substantially adjacent to the sixth leg, and a spaced apart second frame member that is coupled to the first side frame substantially adjacent to the fifth leg and that is coupled to the second side frame substantially adjacent to the sixth leg.

4. The trampoline of claim 1 further comprising a backstop frame that is mounted on the base frame and that extends in a generally upward direction away from the base frame, the backstop frame including a substantially straight first lower support member that is coupled to the base frame, a substantially straight second lower support member that is spaced apart from the first lower support member and that is coupled to the base frame, and a substantially arch shaped upper support member that extends from near a distal end of the first lower support member to near a distal end of the second lower support member.

5. The trampoline of claim 1 wherein the bed suspension assembly resiliently couples the bed to the first inner side frame, the second inner side frame, the first end frame and the second end frame.

6. The trampoline of claim 5 further comprising a plurality of connector bars that are positioned between the first inner side frame and the first outer side frame and between the second inner side frame and the second outer side frame.

7. A trampoline that is adapted to be positioned on a surface, the trampoline comprising:

a bed;

a base frame including a first side frame, a second side frame, a first end frame, and a second end frame;

a bed suspension assembly that resiliently couples the bed to the base frame;

a plurality of legs that are connected to the base frame so as to maintain the base frame above the surface, the plurality of legs including a first leg that is secured to the first side frame and a second leg that is secured to the second side frame; and a center frame that is coupled to the first side frame substantially adjacent to the first leg and that is coupled to the second side frame substantially adjacent to the second leg, the center frame extending in a generally upward direction away from the first side frame and the second side frame.

8. The trampoline of claim 7 wherein the center frame includes a first center frame member that is coupled to the first side frame substantially adjacent to the first leg and that is coupled to the second side frame substantially adjacent to the second leg, and a spaced apart second frame member that is coupled to the first side frame substantially adjacent to the first leg and that is coupled to the second side frame substantially adjacent to the second leg.

9. The trampoline of claim 7 wherein the center frame is integrally formed with the first leg and the second leg.

10. The trampoline of claim 7 further comprising a backstop frame that is mounted on the base frame and that extends in a generally upward direction away from the base frame, the backstop frame including a pair of spaced apart substantially straight lower support members that are coupled to the base frame, and a substantially arch shaped upper support member that extends from near a distal end of one of the lower support members to near a distal end of the other lower support member.

11. The trampoline of claim 7 wherein the first side frame includes a first inner side frame and a first outer side frame, wherein the second side frame includes a second inner side frame and a second outer side frame, and wherein the bed suspension assembly resiliently couples the bed to the first inner side frame, the second inner side frame, the first end frame and the second end frame.

12. The trampoline of claim 11 further comprising a plurality of connector bars that are positioned between the first inner side frame and the first outer side frame and between the second inner side frame and the second outer side frame.

13. A trampoline that is adapted to be positioned on a surface, the trampoline comprising:

a bed;

a base frame;

a bed suspension assembly that resiliently couples the bed to the base frame; and a first backstop frame that is mounted on the base frame and that extends in a generally upward direction away from the base frame, the first backstop frame including a pair of spaced apart substantially straight first lower support members that are coupled to the base frame, and a substantially arch shaped first upper support member that extends from near a distal end of one of the first lower support members to near a distal end of the other first lower support member.

14. The trampoline of claim 13 wherein the base frame includes a first side frame, a second side frame, a first end frame, and a second end frame, the first backstop frame being positioned substantially above at least one of the first side frame, the second side frame, the first end frame, and the second end frame.

15. The trampoline of claim 14 wherein the first side frame includes a first inner side frame and a first outer side frame, wherein the second side frame includes a second inner side frame and a second outer side frame, and wherein the bed suspension assembly resiliently couples the bed to the first inner side frame, the second inner side frame, the first end frame and the second end frame.

16. The trampoline of claim 15 further comprising a plurality of connector bars that are positioned between the first inner side frame and the first outer side frame and between the second inner side frame and the second outer side frame.

17. The trampoline of claim 13 further comprising a second backstop frame that is mounted on the base frame and that extends in a generally upward direction away from the base frame, the second backstop frame including a pair of spaced apart substantially straight second lower support members that are coupled to the base frame, and a substantially arch shaped second upper support member that extends from near a distal end of one of the second lower support members to near a distal end of the other second lower support member.

18. The trampoline of claim 17 further comprising (i) a third backstop frame that is mounted on the base frame and that extends in a generally upward direction from the base frame, the third backstop frame including a pair of spaced apart substantially straight third lower support members that are coupled to the base frame, and a substantially arch shaped third upper support member that extends from near a distal end of one of the third lower support members to near a distal end of the other third lower support member; and (ii) a fourth backstop frame that is mounted on the base frame and that extends in a generally upward direction from the base frame, the fourth backstop frame including a pair of spaced apart substantially straight fourth lower support members that are coupled to the base frame, and a substantially arch shaped fourth upper support member that extends from near a distal end of one of the fourth lower support members to near a distal end of the other fourth lower support member.

19. The trampoline of claim 18 wherein each of the backstop frames is selectively coupled to one or more of the other backstop frames.

20. The trampoline of claim 13 further comprising a plurality of legs that are connected to the base frame so as to maintain the base frame above the surface.

* * * * *